US008469780B2

(12) United States Patent
Huang

(10) Patent No.: US 8,469,780 B2
(45) Date of Patent: Jun. 25, 2013

(54) REVERSE OBLIQUE AIR CURTAIN EXHAUST CABINET

(75) Inventor: Rong Fung Huang, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 889 days.

(21) Appl. No.: 12/620,623

(22) Filed: Nov. 18, 2009

(65) Prior Publication Data

US 2011/0117828 A1 May 19, 2011

(51) Int. Cl.
*B08B 15/20* (2006.01)
*F24C 15/20* (2006.01)

(52) U.S. Cl.
USPC ..... 454/65; 454/59; 454/56; 454/58; 454/63; 126/299 D; 126/299 R

(58) Field of Classification Search
USPC ..... 454/57, 191, 56, 58, 63; 126/299 R, 126/299 D
See application file for complete search history.

(56) References Cited

U.S. PATENT DOCUMENTS 2,855,837 A * 10/1958 Bakke ..... 454/63
4,318,337 A * 3/1982 Wichmann et al. ..... 454/65
5,167,572 A * 12/1992 Etkin ..... 454/57
6,401,709 B1 * 6/2002 Okamoto et al. ..... 126/299 D
6,461,233 B1 * 10/2002 Gilkison et al. ..... 454/57
7,247,087 B1 * 7/2007 Poblete et al. ..... 454/56
7,318,771 B2 1/2008 Huang et al.
2009/0305621 A1 * 12/2009 Eckardt et al. ..... 454/63
2012/0231723 A2 * 9/2012 Dieter et al. ..... 454/193
2012/0276830 A1 * 11/2012 Huang ..... 454/49

FOREIGN PATENT DOCUMENTS

FR 2279484 * 3/1976

* cited by examiner

*Primary Examiner* — Steven B McAllister
*Assistant Examiner* — Nikhil Mashruwala
(74) *Attorney, Agent, or Firm* — Bacon & Thomas, PLLC

(57) ABSTRACT

A reverse oblique air curtain exhaust cabinet comprises a cabinet that has a bottom plate and an elongate air blow slot is provided in front of the bottom plate. Through the elongate air blow slot, air is blown upward at an oblique angle toward the rear plate of the cabinet. An air-extraction hood is provided in a space defined above the bottom plate in a way of being vertically movable relative to the cabinet. The air-extraction hood has an elongate air-extraction part that is parallel to the elongate air blow slot in a way that the elongate air-extraction part is above and spaced from the elongate air blow slot toward the rear plate of the cabinet. Thereby, an oblique air curtain that flows upward is formed to remove the pollutants between the oblique air curtain and rear plate and left and right lateral plates in a more energy-saving way.

20 Claims, 9 Drawing Sheets

REVERSE OBLIQUE AIR CURTAIN EXHAUST CABINET

TECHNICAL FIELD

The present invention relates to an exhaust cabinet, and more particularly, to a reverse oblique air curtain exhaust cabinet, where an oblique air curtain is formed in a cabinet based on the principles of Aerodynamics so as to remove pollutants between the oblique air curtain and rear plate and left and right lateral plates.

BACKGROUND

A conventional exhaust cabinet includes a cabinet. On the upper end of the cabinet is provided with a shelter plate with an opening. In the rear of the cabinet, a flow-guide plate is vertically disposed and the flow-guide plate is provided with a specially designed opening. Through the opening of the shelter plate and the opening of the flow-guide plate in the rear of the cabinet, harmful gas can be drawn out by using an air-extraction machine and ducts. When the exhaust cabinet is used, the air-extraction machine should be operated correspondingly in order to continue air extraction. During this moment, the door of the cabinet should not be closed completely or an opening should be provided at the doorsill in advance in order to prevent from free-running and consequent burning of a motor resulting from failing to supplying air. Besides, when in use, it is usually necessary to open the door of the cabinet to an approximate height to facilitate operators stretching their hands into the cabinet for experimental operations. However, when the door of the conventional exhaust cabinet is open, based on the principles of Aerodynamics, harmful gas within the cabinet may escape easily around the peripheries of the door. Moreover, the leakage may be even severer when operators are opening or closing the door or stand in front of the open cabinet for experimental operations, or when there are ambient drafts or there are people walking by. The main reason of the leakage is that vortex and turbulence are easily formed around the peripheries of the cabinet door and around operators' chests. The vortex and turbulence may result in the mass and momentum exchange between the inside and the outside of the cabinet. Therefore, the leakage of the pollutants in the cabinet is hardly avoidable. Unfortunately, there is nearly no conventional exhaust cabinet can be used without opening and closing its door. In other words, operators can operate their experiments only when the cabinet is open. Besides, the exhaust cabinet is scarcely placed in the environment where there is no ambient air turbulence or there are no people walking by. As a result, in the laboratories, factories, or buildings using the conventional exhaust cabinets, people usually smell the sour odor emitted from chemicals because pollutants continue leaking from the cabinets. Operators and people working thereby may get used to the odor and long-term chemical pollution occurs.

In order to solve the leakage problem resulting from using above conventional exhaust cabinet, a push-pull type exhaust cabinet was developed by US patent (U.S. Pat. No. 7,318,771). As shown in FIGS. 8 and 9, the push-pull type exhaust cabinet "a" mainly includes a cabinet "b". A space is formed in front of the cabinet "b" while an air-extraction slot "c" is formed at the lower part of the front end of the cabinet "b". Besides, a screen board "d" is provided at the upper part of the cabinet "b" for natural air supply. The upper part "e1" of a bi-layered hollow cabinet door "e" is fixed to two sides of the front end of the cabinet "b" while the lower part "e2" thereof is designed to be telescopic, that is, is able to move upward or downward relative to the upper part "e1". When the lower part "e2" is pulled upward, the front end of the cabinet "b" can be closed. Moreover, an air blow slot "e3" is formed in the lower part "e2". When a transverse fan "f" is provided to blow air downward through the air blow slot "e3" while an air-extraction device "g" is provided to draw in the air through the air-extraction slot "c", an air curtain "h" can be formed between the air blow slot "e3" and the air-extraction slot "c" that are disposed correspondingly to each other in order to remove harmful gas.

The left, right, and rear sides of the cabinet of the push-pull type exhaust cabinet are completely closed to prevent from the leakage of harmful gas while the front side thereof is provided with an open space for operation. However, in practice, because the air curtain forms at the interface of the cabinet door's opening, ambient air turbulence evoked by operators' operation or other factors in the outer environment may result in the leakage of pollutant gas. For example, when the position at which the pollutant source is released is too high or the hands of an operator are fairly close to the air blow source of the bi-layered cabinet door, it may evoke some problems, such as a problem that the internal space of the cabinet is insufficient, another problem that the air extraction ability should be greatly elevated, or still another problem that the pollutants may leak through the hands of the operator. Moreover, under the condition of producing high-temperature harmful gas or of emergency, it is necessary to decrease the extent of the opening of the cabinet door of the push-pull type exhaust cabinet and increase the amount of air extraction. These are all the shortcomings required to overcome.

In order to overcome above shortcomings, inventor had the motive to study and develop the present invention. After hard research and development, the inventor provides a reverse oblique air curtain exhaust cabinet, by using which it is able to reduce effectively the leakage of pollutants, to enhance the ability against the ambient air turbulence, and to remove pollutants in a more energy-saving way.

SUMMARY OF THE DISCLOSURE

An object of the present invention is to provide a reverse oblique air curtain exhaust cabinet provided with an elongate air blow slot that is located in front of the bottom plate of a cabinet and disposed with an elongate air-extraction part parallel to the elongate air blow slot in a way that the elongate air-extraction part is above and spaced from the elongate air blow slot, so that an oblique air curtain is formed to remove pollutants between the oblique air curtain and rear plate and left and right lateral plates and to enhance the ability against ambient air turbulence. Consequently, the leakage of pollutants can be reduced.

Another object of the present invention is to provide a reverse oblique air curtain exhaust cabinet provided with an air-extraction hood that is located in the space of the cabinet in a way of being vertically movable relative to the cabinet. Consequently, it is able to adjust the height of the space of the cabinet in order to handle pollutant sources at different heights in an energy-saving way.

In order to achieve above objects, the present invention provides a reverse oblique air curtain exhaust cabinet comprising a cabinet, an elongate air blow device, and an air-extraction hood. The cabinet has a top plate, a bottom plate, a left lateral plate, a right lateral plate, a front plate, and a rear plate, where above plates define a space and an opening is provided below the front plate of the cabinet. The elongate air blow device has an elongate air blow slot that is located in front of the bottom plate of the cabinet and through which air is blown upward at an oblique angle toward the rear plate of the cabinet. The air-extraction hood is located in the space of the cabinet in a way of being vertically movable relative to the cabinet and includes an elongate air-extraction part that has an air-extraction opening facing downward and is connected with an air-extraction machine, The elongate air-extraction part is parallel to the elongate air blow slot in a way that the elongate air-extraction part is above and spaced from the elongate air blow slot toward the rear plate of the cabinet. Consequently, an oblique air curtain that is nearly two-dimensional is formed between the elongate air blow device and the elongate air-extraction part when the air-extraction part and the elongate air blow device work.

In practice, the elongate air blow slot of the elongate air blow device is in communication with a cross-flow fan, an air blower, or other fluid mechanisms capable of drawing in air and is connected with a duct for outdoor operation. When a cross-flow fan is used, it is placed under a counter top. If a storage cabinet is placed under the counter top, the storage cabinet can be provided with plural openings for drawing in air from outside to supply air to the cross-flow fan. If an air blower or other fluid mechanisms are used, these can be connected with ducts for operation at suitable places or outdoors.

In practice, the air-extraction hood is in communication with a cross-flow fan, an air blower, or other fluid mechanisms capable of extracting air and is connected with a duct for operation at suitable places or outdoors.

In practice, the front end and the rear end of the flange are respectively provided with a rail while the front plate and the rear plate are respectively provided with a track for being connected with a corresponding rail, so that the air-extraction hood is vertically movable in the space.

In practice, the air-extraction hood further includes a positioning plate fixed above the flange. The front end and the rear end of the positioning plate are respectively provided with a rail while the front plate and the rear plate are respectively provided with a track for being connected with a corresponding rail, so that the air-extraction hood is vertically movable in the space.

The following detailed description, given by way of examples or embodiments, will best be understood in conjunction with the accompanying drawings.

DETAILED DESCRIPTION

Figure 1:
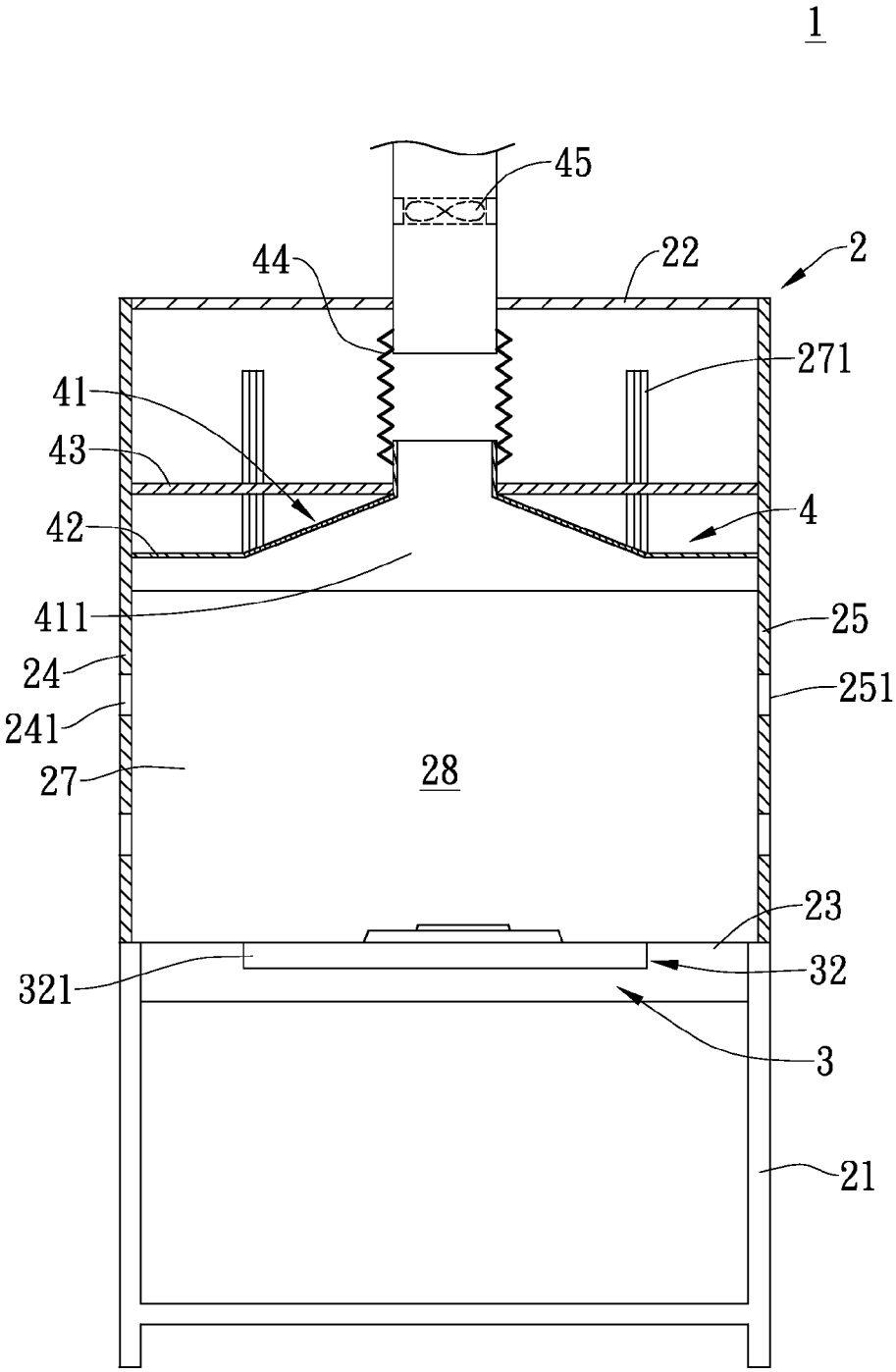
FIG. 1 shows a front side cross-sectional view of a first embodiment of the present invention.
Figure 2:
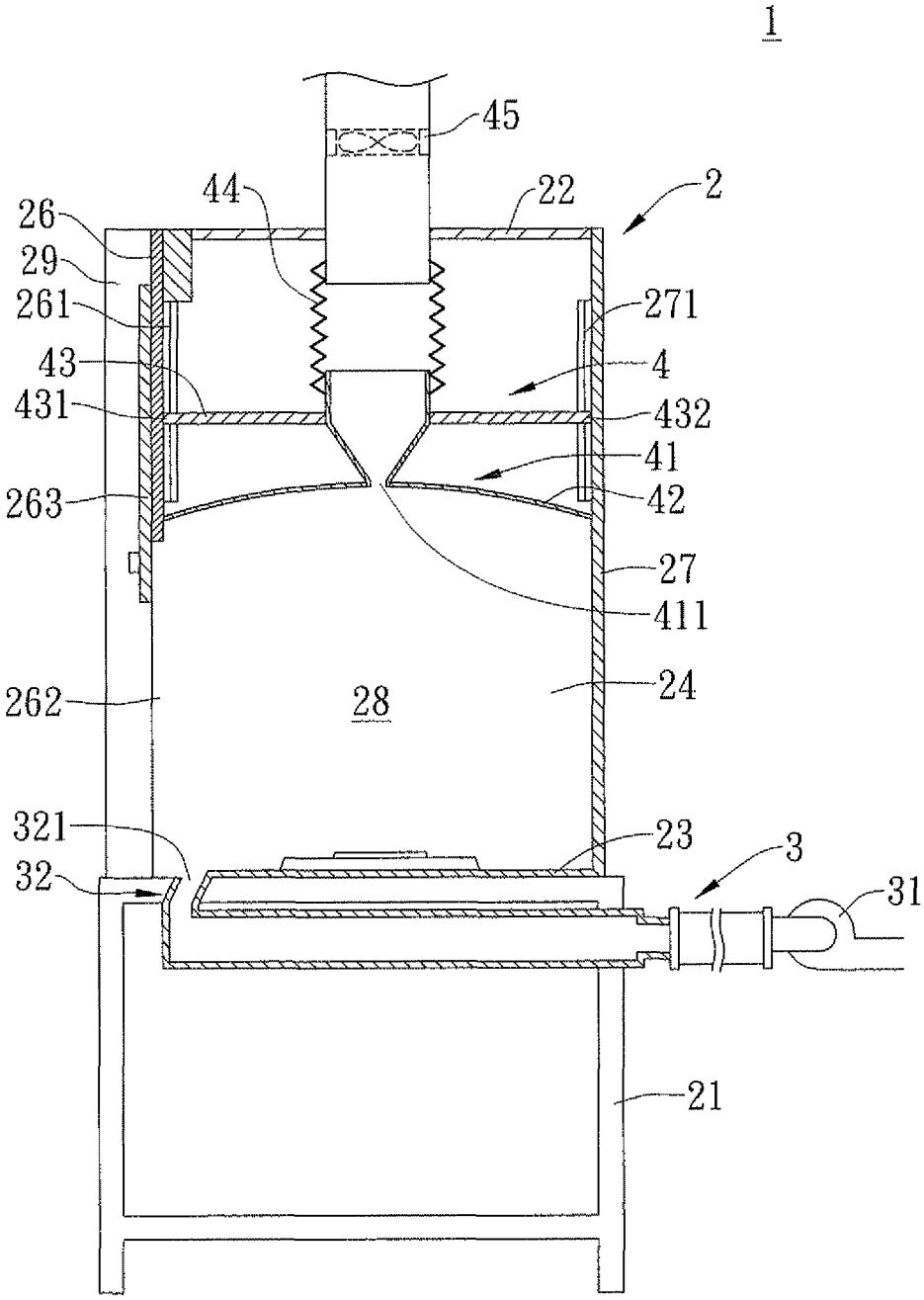
FIG. 2 shows a lateral side cross-sectional view of the first embodiment of the present invention.

Please refer to FIGS. 1 and 2 showing a first embodiment of a reverse oblique air curtain exhaust cabinet 1 that comprises a cabinet 2, an elongate air blow device 3, and an air-extraction hood 4.

The cabinet 2 is generally in rectangular shape. The lower part of the cabinet 2 is provided with a storage cabinet 21 for storage purpose. The storage cabinet 21 has legs for supporting the cabinet 2. The cabinet 2 has a top plate 22, a bottom plate 23, a left lateral plate 24, a right lateral plate 25, a front plate 26, and a rear plate 27. After being assembled together, above plates define a space 28 within the cabinet 2. The front plate 26 and the rear plate 27 are respectively provided with a track 261, 271. The left side and the right side of the front end of the cabinet 2 are respectively provided with an upright post 29 for positioning respectively the left and right sides of the front plate 26. An opening 262 is formed at the lower part of the front plate 26. Parts of the upright posts 29 near the opening are designed in a streamline shape or a curved shape in order to reduce the turbulence and the interference that are produced during air is extracted in the opening 262. A door 263 overlaps partially the front plate 26 for closing most of the opening 262 and is vertically movable relative to the front plate 26 for controlling the opening degree of the door 263.

The elongate air blow device 3 has an elongate air blow slot 32 that is located in front of the bottom plate 23 of the cabinet 2 and has an opening 321, The opening 321 is roughly in elongate rectangular shape. Besides, the elongate air blow slot 32 is in communication with an air blower that is used as an air blow device 31. By means of the air blow device 31, through the opening 321, a two-dimensional air jet is blown upward toward the rear plate 26 of the cabinet 2. In practice, the air blow device 31 can be replaced with a cross-flow fan or other fluid mechanisms. When the air blow device 31 is an air blower or other fluid mechanisms, it is connected with a duct for operation at suitable places or outdoors. If the air blow device 31 is a cross-flow fan, the storage cabinet 21 is provided with plural openings at the peripheries thereof for drawing outside air into the storage cabinet 21 to supply air to the cross-flow fan.

Figure 3:
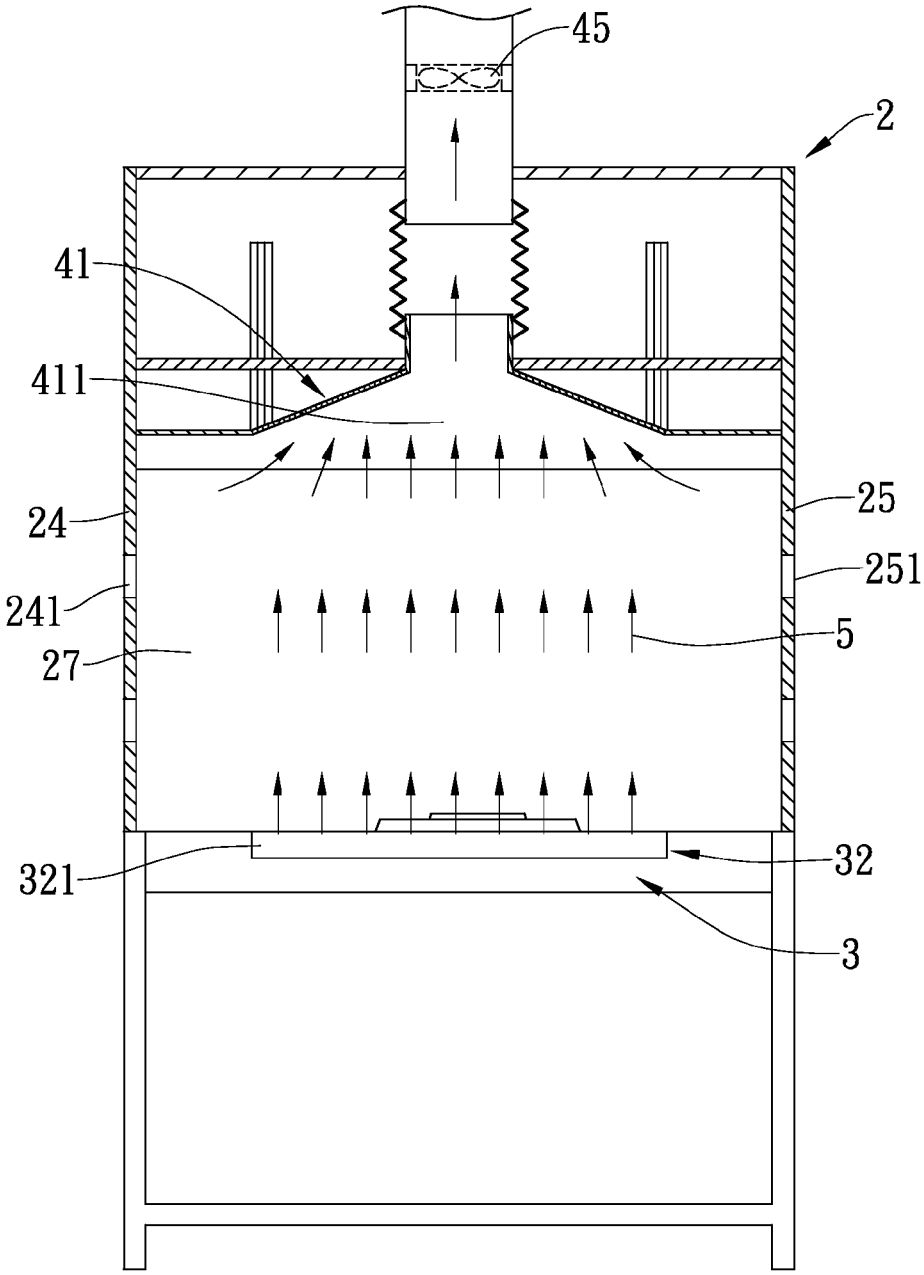
FIGS. 3 and 4 show the use of the first embodiment of the present invention.
Figure 4:
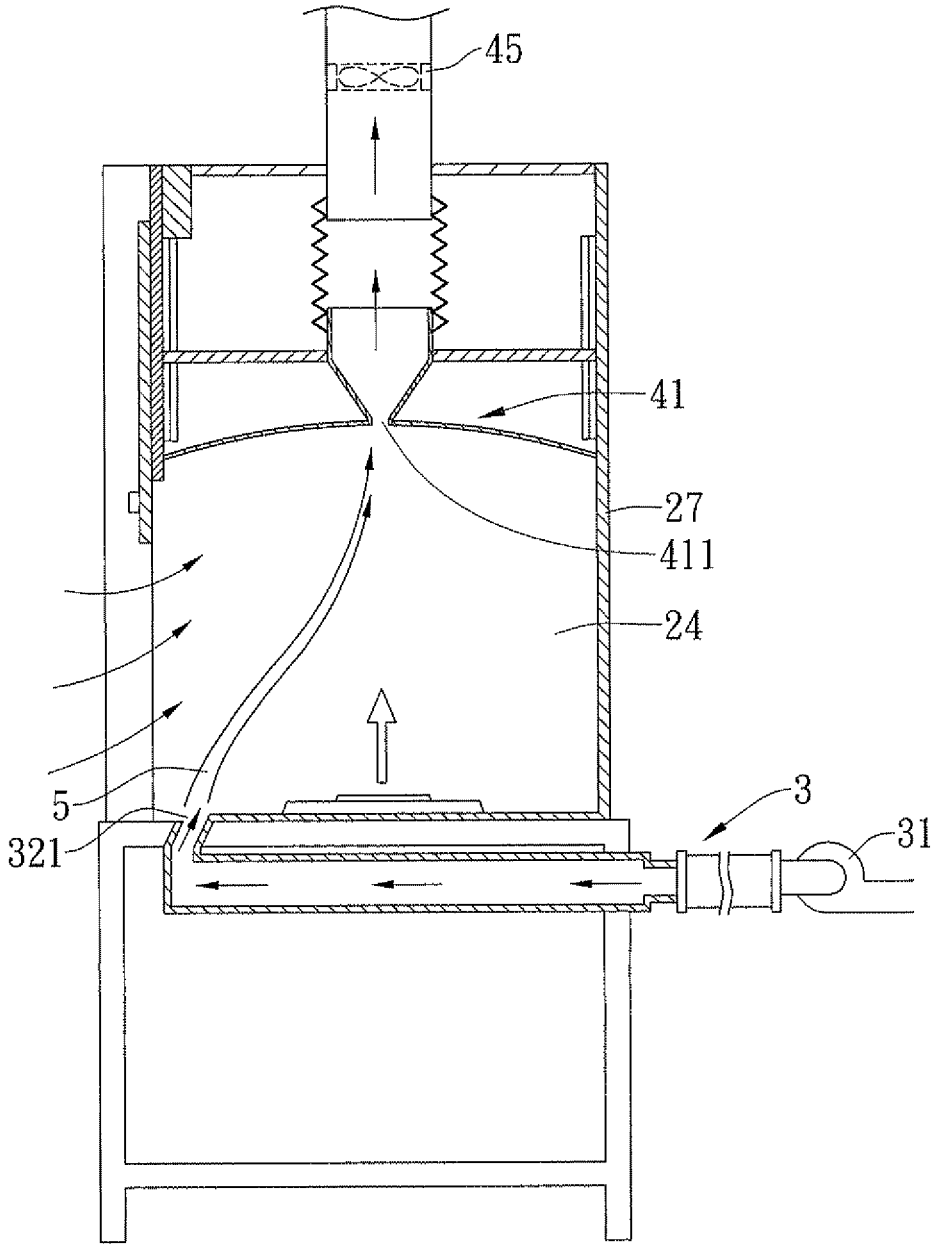

The air-extraction hood 4 includes an elongate air-extraction part 41, a flange 42, and a positioning plate 43. The positioning plate 43 can be a support frame. The elongate air-extraction part 41 forms an air-extraction opening 411 facing downward. The air-extraction opening 411 is roughly in elongate rectangular shape. The upper end of elongate air-extraction part 41 is upward connected with an air-extraction machine 45 via a telescopic tube 44 for extracting air and guiding the air in the cabinet 2 to flow upward. The telescopic tube 44 can be replaced with plural sleeves. The air-extraction machine 45 can be a drawing fan, air blower, or other fluid mechanisms capable of extracting air and can be connected with a duct for operation at suitable places or outdoors. Moreover, the elongate air-extraction part 41 is parallel to the elongate air blow slot 32 in a way that the elongate air-extraction part 41 is above and spaced from the elongate air blow slot 32 toward the rear plate 27 of the cabinet 2. When the air-extraction machine 45 and the air blow device 31 are synchronically operated, air jet is blown upward through the opening 321 and is extracted into the air-extraction opening 411, so that an oblique air curtain 5 (as shown in FIGS. 3 and 4) that is nearly two-dimensional is formed between the elongate air-extraction part 41 and the elongate air blow slot 32. Consequently, the pollutants between the oblique air curtain 5 and the rear plate 27 and left and right lateral plates 24, 25 of the cabinet 2 are moved upward by stable airflow into the air-extraction hood 4 and then discharged outwards via the air-extraction opening 411.

Figure 5:
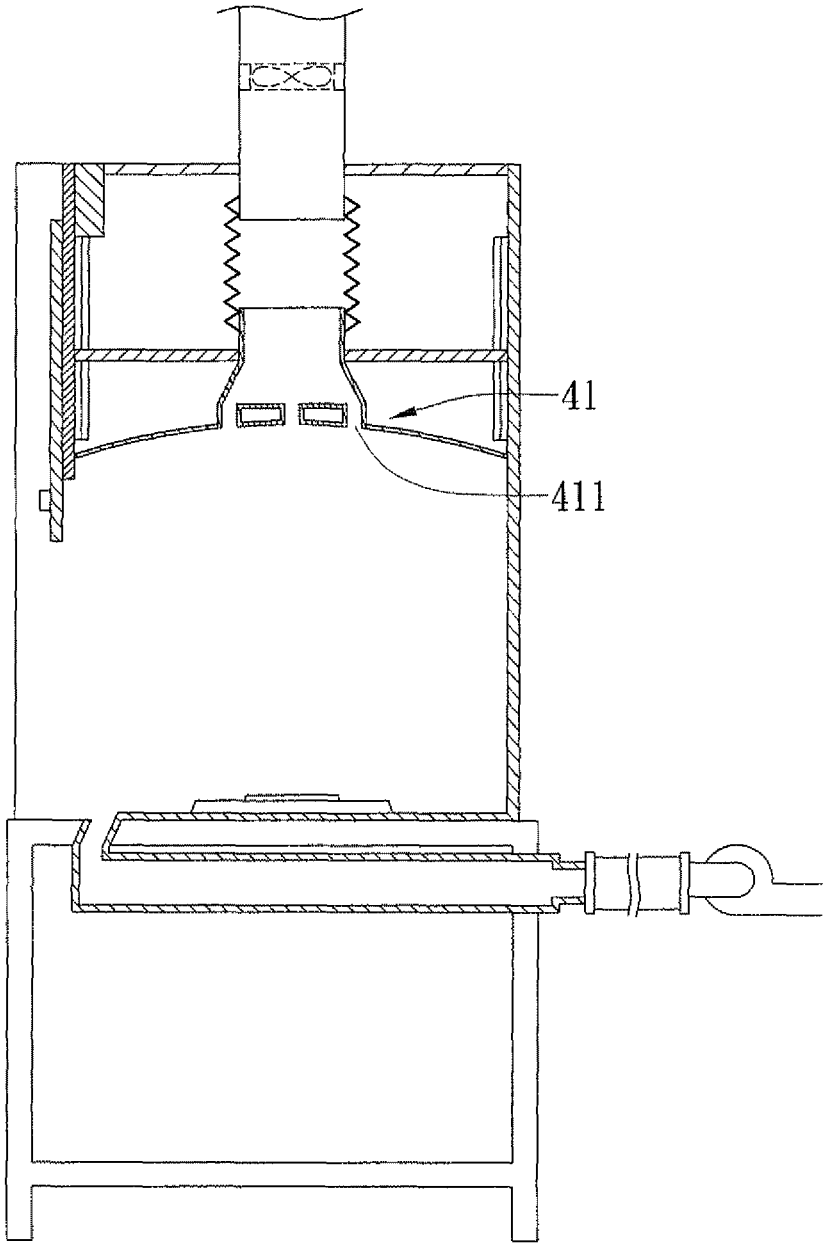
FIG. 5 shows a cross-sectional view of the present invention where there are plural air-extraction openings.

The flange 42 extends outward from the peripheries of the elongate air-extraction part 41 and is used to prevent pollutants from moving upward and to guide the pollutants into the air-extraction opening 411. As shown in FIG. 5, the elongate air-extraction part 41 has plural air-extraction openings 411 and the air-extraction openings 411 are parallel to each other. Besides, the air-extraction opening 411 can be designed in grid pattern, by which the pollutants can be extracted as well.

Figure 6:
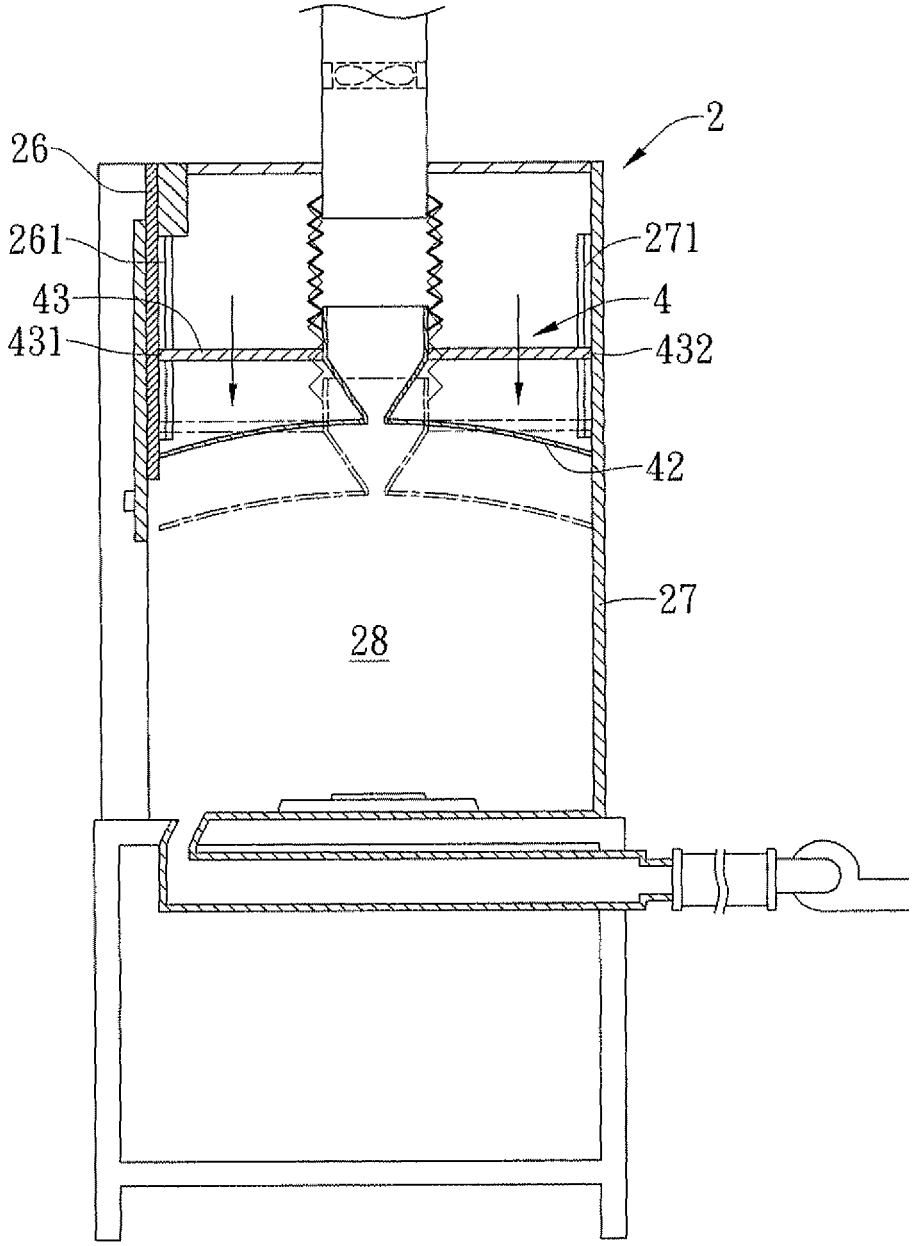
FIG. 6 is a schematic view of the present invention showing that the air-extraction hood is vertically movable in the space of the cabinet.

As shown in FIG.6, the positioning plate 43 is used to position and fasten the air-extraction hood 4 with the flange 42. The front end and the rear end of the positioning plate 43 are respectively provided with a rail 431, 432. These two rails 431, 432 are located corresponding to the tracks 261, 271 located at the front plate 26 and the rear plate 27, so as to make the air-extraction hood 4 vertically movable in the space 28 of the cabinet 2. Besides, the rails 431, 432 of the positioning plate 43 also can be provided directly at the front and rear ends of the flange 42 to be corresponding to the tracks 261, 271 located at the front plate 26 and the rear plate 27, so as to make the air-extraction hood 4 vertically movable in the space 28 of the cabinet 2. In practice, the tracks 261, 271 also can be disposed on the left and right lateral plates 24, 25 while the left and right ends of the support frame or the positioning plate 43 are respectively disposed with a rail 431, 432. Moreover, the air-extraction hood 4 can be moved upward or downward by means of a suspension cord or a counter weight mechanism in a mechanically manual, electrical, pneumatic, or oil hydraulic way.

In practice, the left and right lateral plates 24, 25 are not air permeable. However, the left and right lateral plates 24, 25 also can be provided with plural air holes 241, 251 (as shown in FIGS. 1 and 3) or slots to draw air into the cabinet 2 for supplying air. Accordingly, pollutants can be carried by stable airflow upward to the air-extraction hood 4 and discharged there from.

In practice, the left and right lateral plates 24, 25 are not air permeable. However, the left and right lateral plates 24, 25 also can be provided with plural air holes or slots to draw air into the cabinet 2 for supplying air. Accordingly, pollutants can be carried by stable airflow upward to the air-extraction hood 4 and discharged there from.

Figure 7:
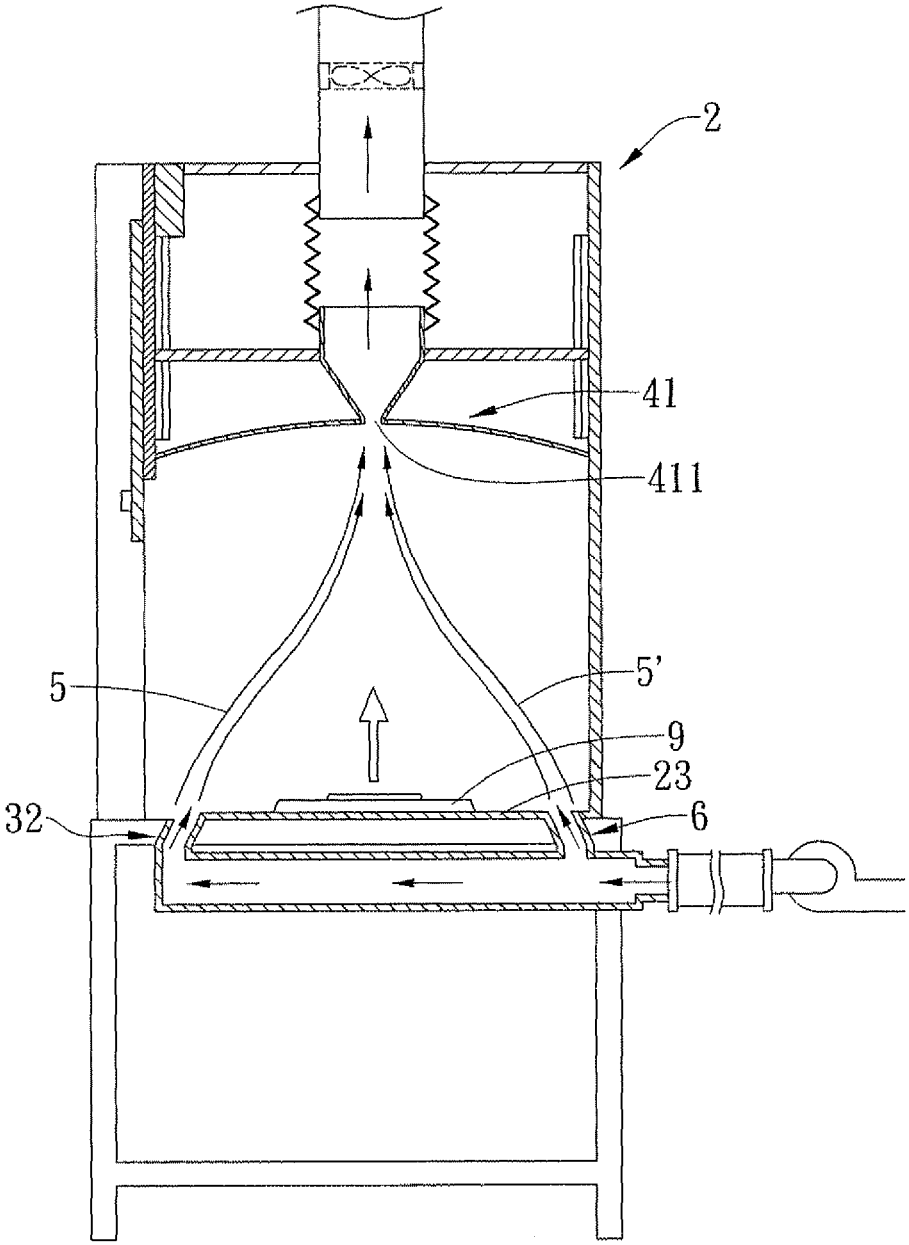
FIG. 7 shows the use of a second embodiment of the present invention.
Figure 8:
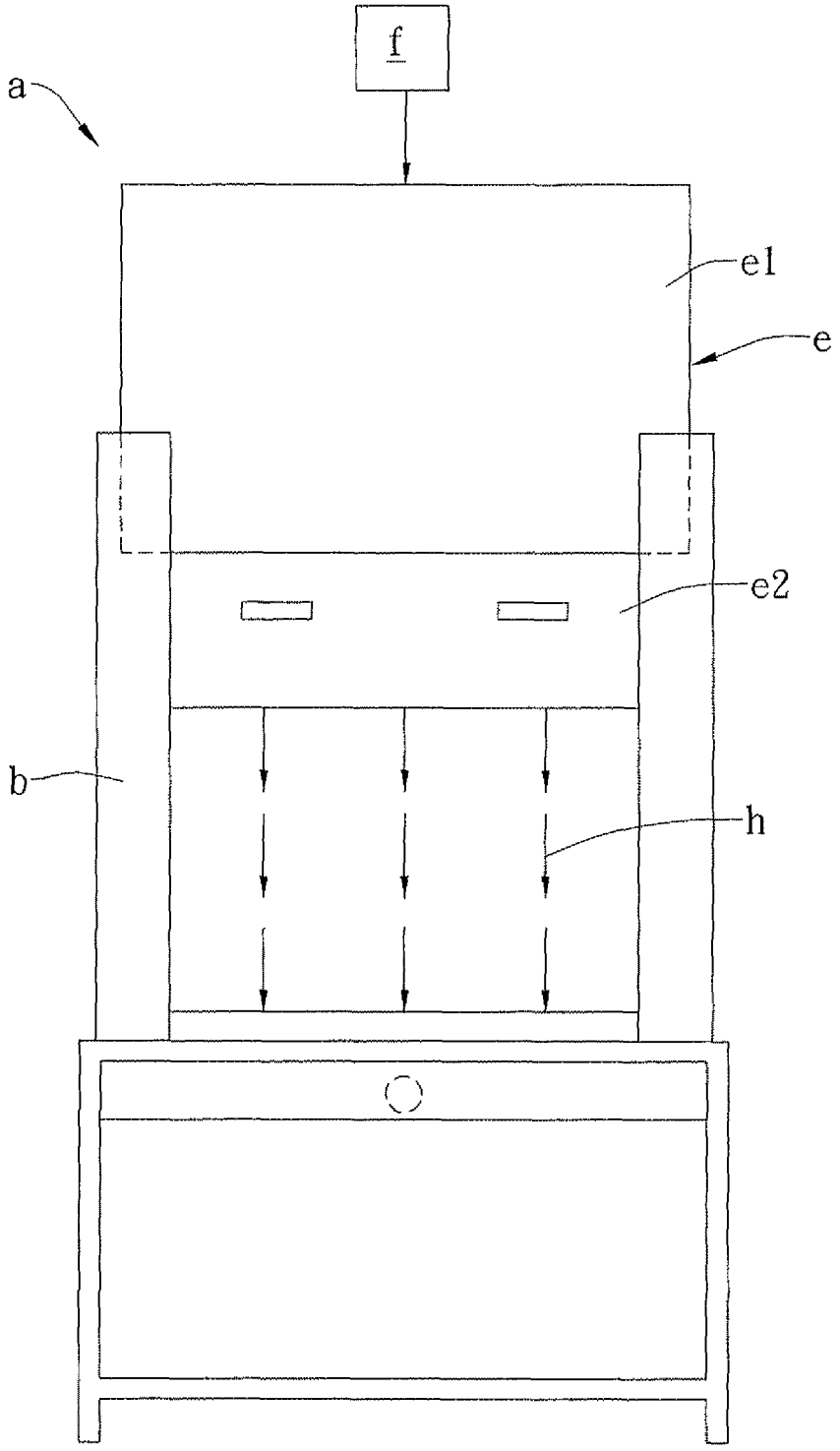
Fig. 8(Prior Art)
FIG. 8 shows a front side view of a conventional push-pull type exhaust cabinet.
Figure 9:
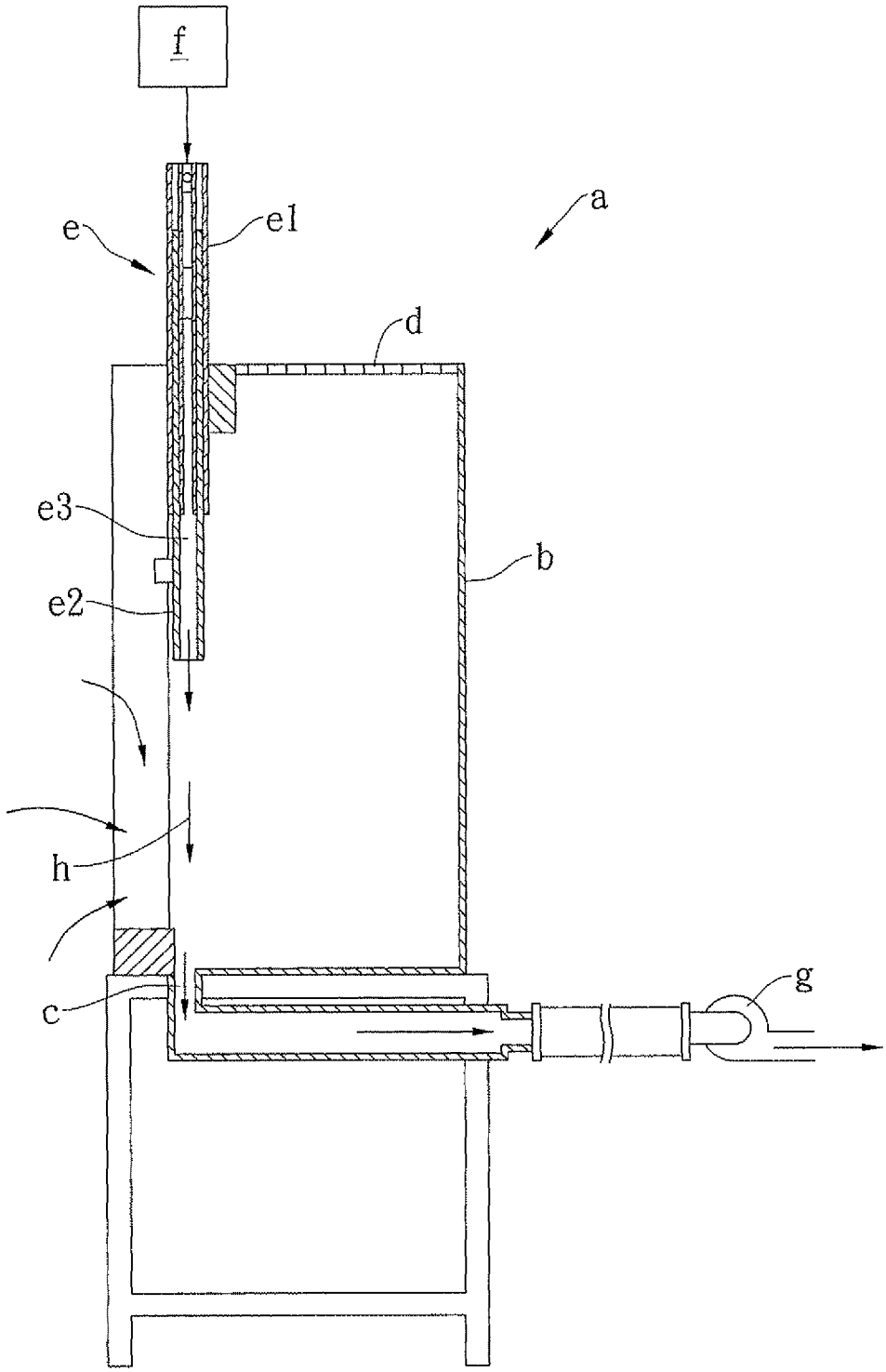
Fig. 9(Prior Art)
FIG. 9 shows a cross-sectional view of the conventional push-pull type exhaust cabinet.

As shown in FIG. 7, a second embodiment of the reverse oblique air curtain exhaust cabinet according to the present invention is shown. In this embodiment, a rear elongate air blow slot 6 is further provided in the rear of the bottom plate 23 of the cabinet 2. The rear elongate air blow slot 6 is parallel to the elongate air blow slot 32. Through the rear elongate air blow slot 6, air jet is blown upward toward the elongate air-extraction part 41. Thereby, when a two-dimensional airflow is respectively blown out from the elongate air blow slot 32 and the rear elongate air blow slot 6 and the two airflows are extracted upward into the two-dimensional air-extraction opening 411, two oblique two-dimensional air curtains 5, 5' are shown in the side view of the fluid field. Therefore, the pollutants moved upward from the pollutant source 9 on the bottom plate 23 can be discharged upward. In practice, the rear plate 27 of the cabinet 2 also can be made air permeable in order to form two oblique two-dimensional air curtains 5, 5'.

Therefore, the present invention has following advantages:

1. According to the present invention, one or two oblique two-dimensional air curtains can be formed. Thereby, it is capable of restraining pollutants within the cabinet, enhancing the ability against ambient air turbulence, and removing pollutants effectively in order to reduce the leakage of the pollutants.
2. According to the present invention, the air-extraction hood is vertically movable in the space of the cabinet. Thereby, it is able to handle pollutant sources at different heights flexibly. The pollutants at a position of relatively lower height can be handled in an energy-saving way by decreasing the height of the air-extraction hood in the space. The pollutants at a position of relatively higher height in the space also can be handled in an energy-saving way by elevating the air-extraction hood close to the pollutant source.
3. According to the present invention, through the upper elongate air-extraction opening, the pollutant gas that is at high temperature and may rush upward as a result of buoyancy effect can be removed safely.

As disclosed in the above description and attached drawings, the present invention can provide a reverse oblique air curtain exhaust cabinet capable of reducing the escape of pollutants effectively, enhancing the ability against the ambient air turbulence, and removing pollutants in a more energy-saving way. It is new and can be put into industrial use.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A reverse oblique air curtain exhaust cabinet, comprising:

a cabinet, having a top plate, a bottom plate, a left lateral plate, a right lateral plate, a front plate, and a rear plate, where above plates define a space, and an opening is provided at the lower part of the front plate of the cabinet;

an elongate air blow device, having an elongate air blow slot that is located in front of the bottom plate of the cabinet and through which air is blown upward at an oblique angle toward the rear plate of the cabinet; and an air-extraction hood, located in the space of the cabinet in a way of being vertically movable relative to the cabinet and including an elongate air-extraction part that has an elongate opening facing downward and is connected with an air-extraction machine, where the elongate opening is parallel to the elongate air blow slot in a way that the elongate air-extraction part is above and spaced from the elongate air blow slot toward the rear plate of the cabinet, so that an oblique air curtain that is two-dimensional is formed between the elongate air-extraction part and the elongate air blow slot when the air-extraction machine is operated;

wherein the air-extraction hood includes a flange that is extended outward from the peripheries of the elongate air-extraction part; the flange's front end and rear end are respectively provided with a rail; the front plate and the rear plate are respectively provided with a track for being connected with a corresponding rail, so that the air-extraction hood is vertically movable in the space.

2. The reverse oblique air curtain exhaust cabinet as claimed in claim 1, wherein the elongate air blow slot of the elongate air blow device is in communication with an air blow device.

3. The reverse oblique air curtain exhaust cabinet as claimed in claim 1, wherein the left lateral plate and the right lateral plate are respectively provided with a hole through which air flows in naturally.

4. The reverse oblique air curtain exhaust cabinet as claimed in claim 1, wherein the elongate air-extraction part is provided with plural air-extraction openings that are parallel to each other.

5. The reverse oblique air curtain exhaust cabinet as claimed in claim 1, further including a rear elongate air blow slot that is located in the rear of the bottom plate of the cabinet and is parallel to the elongate air blow slot; where through the rear elongate air blow slot, air is blown upward toward the elongate air-extraction part.

6. The reverse oblique air curtain exhaust cabinet as claimed in claim 1, wherein a door of the cabinet partially overlaps the front plate for closing most part of the opening and the door is slidable vertically in order to control the opening of the door.

7. The reverse oblique air curtain exhaust cabinet as claimed in claim 6, wherein the elongate air blow slot of the elongate air blow device is in communication with an air blow device.

8. The reverse oblique air curtain exhaust cabinet as claimed in claim 6, wherein the left lateral plate and the right lateral plate are respectively provided with a hole through which air flows in naturally.

9. The reverse oblique air curtain exhaust cabinet as claimed in claim 6, wherein the elongate air-extraction part is provided with plural air-extraction openings that are parallel to each other.

10. The reverse oblique air curtain exhaust cabinet as claimed in claim 6, further including a rear elongate air blow slot that is located in the rear of the bottom plate of the cabinet and is parallel to the elongate air blow slot; where through the rear elongate air blow slot, air is blown upward toward the elongate air-extraction part.

11. A reverse oblique air curtain exhaust cabinet, comprising:

a cabinet, having a top plate, a bottom plate, a left lateral plate, a right lateral plate, a front plate, and a rear plate, where above plates define a space, and an opening is provided at the lower part of the front plate of the cabinet;

an elongate air blow device, having an elongate air blow slot that is located in front of the bottom plate of the cabinet and through which air is blown upward at an oblique angle toward the rear plate of the cabinet; and an air-extraction hood, located in the space of the cabinet in a way of being vertically movable relative to the cabinet and including an elongate air-extraction part that has an elongate opening facing downward and is connected with an air-extraction machine, where the elongate opening is parallel to the elongate air blow slot in a way that the elongate air-extraction part is above and spaced from the elongate air blow slot toward the rear plate of the cabinet, so that an oblique air curtain that is two-dimensional is formed between the elongate air-extraction part and the elongate air blow slot when the air-extraction machine is operated;

wherein the air-extraction hood further includes a flange that is extended outward from the peripheries of the elongate air-extraction part; and wherein the air-extraction hood further includes a positioning plate fixed above the flange; the front end and rear end of the positioning plate are respectively provided with a rail, the front plate and rear plate are respectively provided with a track for being connected with a corresponding rail, so the air-extraction hood is vertically movable in the space.

12. The reverse oblique air curtain exhaust cabinet as claimed in claim 11, wherein the elongate air blow slot of the elongate air blow device is in communication with an air blow device.

13. The reverse oblique air curtain exhaust cabinet as claimed in claim 11, wherein the left lateral plate and the right lateral plate are respectively provided with a hole through which air flows in naturally.

14. The reverse oblique air curtain exhaust cabinet as claimed in claim 11, wherein the elongate air-extraction part is provided with plural air-extraction openings that are parallel to each other.

15. The reverse oblique air curtain exhaust cabinet as claimed in claim 11, further including a rear elongate air blow slot that is located in the rear of the bottom plate of the cabinet and is parallel to the elongate air blow slot; where through the rear elongate air blow slot, air is blown upward toward the elongate air-extraction part.

16. The reverse oblique air curtain exhaust cabinet as claimed in claim 11, wherein a door of the cabinet partially overlaps the front plate for closing most part of the opening and the door is slidable vertically in order to control the opening of the door.

17. The reverse oblique air curtain exhaust cabinet as claimed in claim 16, wherein the elongate air blow slot of the elongate air blow device is in communication with an air blow device.

18. The reverse oblique air curtain exhaust cabinet as claimed in claim 16, wherein the left lateral plate and the right lateral plate are respectively provided with a hole through which air flows in naturally.

19. The reverse oblique air curtain exhaust cabinet as claimed in claim 16, wherein the elongate air-extraction part is provided with plural air-extraction openings that are parallel to each other.

20. The reverse oblique air curtain exhaust cabinet as claimed in claim 16, further including a rear elongate air blow slot that is located in the rear of the bottom plate of the cabinet and is parallel to the elongate air blow slot; where through the rear elongate air blow slot, air is blown upward toward the elongate air-extraction part.

* * * * *